United States Patent [19]

Lacchia

[11] 4,110,486

[45] Aug. 29, 1978

[54] ELECTROSTATIC POWDER COATING METHOD

[76] Inventor: Adrien Lacchia, 10 Impasse des Lecheres, 38240 Meylan, France

[21] Appl. No.: 726,105

[22] Filed: Sep. 24, 1976

Related U.S. Application Data

[63] Continuation-in-part of Ser. No. 640,924, Dec. 15, 1975, abandoned.

[30] Foreign Application Priority Data

Jan. 16, 1975 [FR] France ..... 75 02009

[51] Int. Cl.[2] ..... B05D 1/06

[52] U.S. Cl. ..... 427/27

[58] Field of Search ..... 427/27, 14; 239/3, 15

[56] References Cited

U.S. PATENT DOCUMENTS 3,263,127 7/1966 Point et al. ..... 427/14 X 3,498,541 3/1970 Taylor et al. ..... 239/15

3,558,052 1/1971 Dunn ..... 239/3

*Primary Examiner*—James R. Hoffman

*Attorney, Agent, or Firm*—Brisebois & Kruger

[57] ABSTRACT

Electrostatic powder-coating method, whereby a fan-spray of electrically charged powder particles is directed toward an object to be coated, said spray being formed from an incident stream consisting of a mixture of powder and carrier-gas, comprising means for re-homogenizing said incident stream, means for subsequently deflecting said stream in a direction substantially perpendicular to its incident direction, means for thereafter driving said stream against the internal walls of a duct designed to convert said stream into a fan-shaped spray, and means for electrically charging the powder particles of the said spray. The re-homogenizing means may, however, be omitted in certain cases.

3 Claims, 5 Drawing Figures

ELECTROSTATIC POWDER COATING METHOD

SUMMARY OF THE INVENTION

This application is a continuation-in-part of Ser. No. 640,924, filed Dec. 15, 1975 and now abandoned.

The present invention relates to a method and an apparatus for coating objects by the method of electrostatic powder-coating or possibly flocking, according to which the powder or flock stream, mixed with its transporting gas, is converted into a fan-shaped spray before reaching the object to be coated.

Generally speaking, in the industrial coating of objects with manual or automatic guns, most users of such guns require them to be adapted to be fitted with a fan-spray exit nozzle, since such a fan-spray is more suitable than a conventional round spray for coating certain parts. At present, so far as coating objects with liquid paints or similar products is concerned, most atomizing guns may be fitted with at least one fan-spray nozzle.

In the particular technique of electrostatic powder-coating, there is likewise heavy demand on the part of users for the possibility of using a fan-spray. Moreover, as was emphasized in the U.S. Pat. No. 3,263,127, a fan-spray is of particular interest in electrostatic powder-coating, since the powder particles, thanks to the fan shape, may be more easily charged by ion bombardment. Since the duct carrying the "powder-transporting gas" mixture to the gun is cylindrical and of small diameter (in general, 7 to 10 millimeters), it is not easy to change such a cylindrical stream into a homogeneous fan-spray several centimeters wide. Shaping the stream by simply transforming the shape of the duct, as shown in FIGS. 7 to 9 of U.S. Pat. No. 3,263,127, is not entirely satisfactory, as the spray obtained is bound to lack homogeneity on account of the high degree of mechanical inertia of the powder particles, the majority of which tend to come out through the center of the outlet slit, while very few emerge at its edges. Moreover, if such a nozzle is placed with the fan-spray in a vertical position, experience shows that due to the effect of gravity most of the powder particles come out toward the bottom of the slit.

To overcome these drawbacks, there has already been suggested, as described in U.S. Pat. No. 3,870,232, a nozzle equipped with separate outlet tubes, the powder being sucked into each of them by means of auxiliary air being injected through holes of a given diameter, which produces perfect homogeneity of the total spray, whatever the angle of the nozzle. Such a nozzle functions with a strong air flow, which is advantageous in certain cases, for example when it is wished to powder-coat at a distance, but which is often not desired, since a powerful air flow may prevent powder being deposited on certain shapes of objects, due to a blowing effect. Finally, it is well known that greater electrostatic efficiency is obtained when the powder particles are slowed down as they leave the nozzle, this enabling them to follow the lines of force of the electric field more easily; a strong axial air flow, however, increases the axial speed of the stream.

The process and device according to the invention make it possible to overcome the drawbacks of the previous systems, and so to produce an electrostatic spraying nozzle which provides at its outlet a fan-spray of powder particles, the contents of said spray being homogeneous whatever its angle may be, and its speed being slow compared with the speed of the incident powder-carrier gas mixture.

For this purpose, according to the invention, the said incident mixture is re-homogenized, if necessary, and is then deflected in a direction substantially perpendicular to its incident direction, so that it strikes the walls of a duct, the function of which is to shape the said mixture into a fan-spray which is then directed towards the object after ion bombardment by an electrostatic charging device.

It will be appreciated that the powder is uniformly suspended in the carrier gas when it leaves the powder extraction device. If the speed of the stream of carrier gas is high, that is to say greater than about 15 meters/-second, and there are no substantial bends in the passage leading from the powder extraction device to the nozzle, the powder will remain homogeneously distributed throughout the gas stream.

If, however, the stream travels at a low speed (less than about 15 meters/second) the particles tend to fall toward the bottom of the passage, so as to become more concentrated in the lower part of the passage.

On the other hand, when a bend in the passage is encountered, regardless of the speed of the stream, the inertia of the particles causes them to become more concentrated in that portion of the passage adjacent the side of the duct wall against which the stream impinges when it reaches the bend.

In each of the latter two cases means for re-homogenizing the mixture are required.

An apparatus in accordance with the invention, and putting into effect the said method, advantageously consists of an electrostatic powder-coating or flocking nozzle which comprises successively:

- a re-homogenizing device, if necessary. This device may be formed, for example, by a convergent-divergent passage;
- a deflector, formed by a circular plate substantially perpendicular to the axis of the nozzle;
- a duct for converting the cylindrical shape of the stream to an elongated oblong shape, leading to the outlet slit of the nozzle.

The invention will be more readily understood from the following description of an electrostatic powder nozzle according to the invention, with reference to the accompanying drawings, in which:

FIG. 2 is an axial sectional view taken through the nozzle according to the invention, in the plane (A – B) of FIG. 1;

As shown by the same reference numerals on FIGS. 1 to 5, the electrostatic powder nozzle according to the invention, drawn on the scale of 2/1, comprises the following elements:

Figure 1:
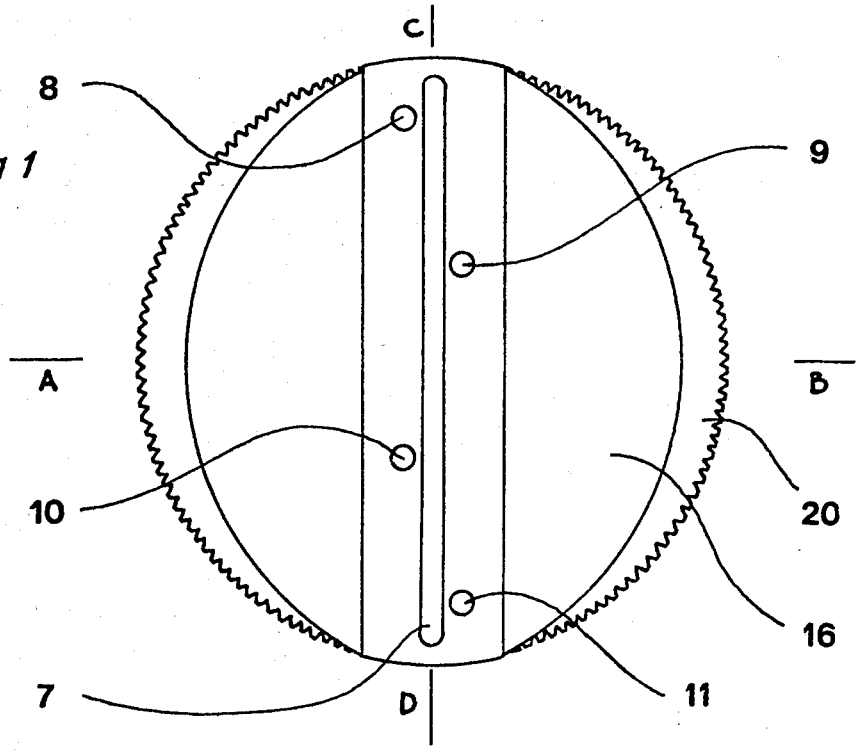
FIG. 1 is a front view of the electrostatic powder nozzle according to the invention.
Figure 4:
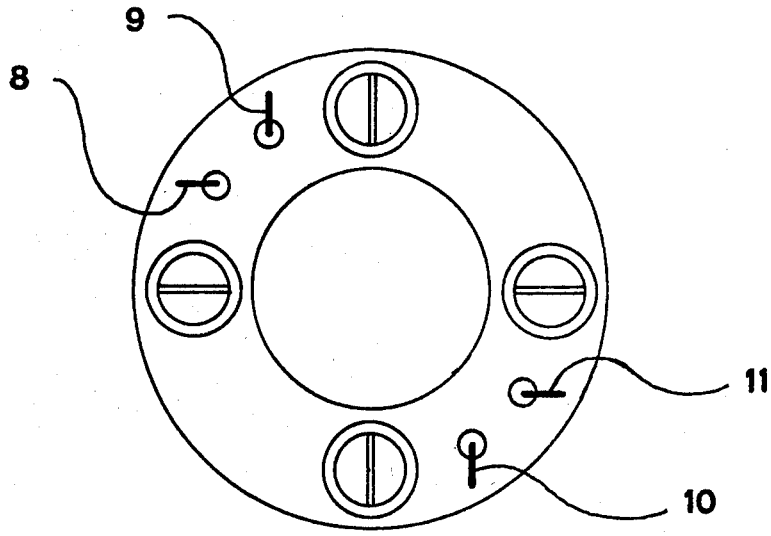
FIG. 4 is a rear view of said last-mentioned part.
Figure 3:
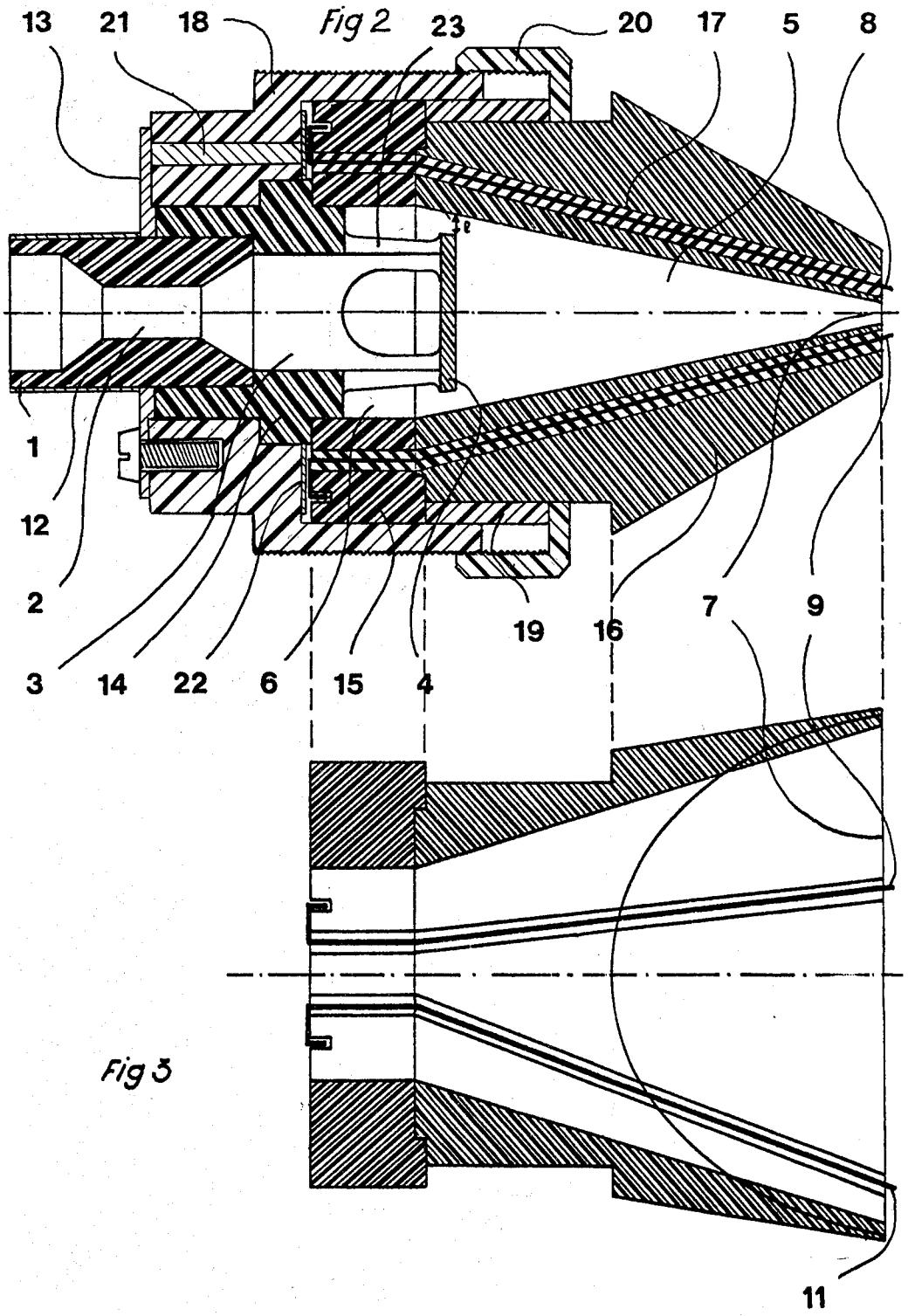
FIG. 3 is a cross-sectional view taken along the line (C – D) of FIG. 1, of the part of said nozzle comprising the charging electrodes.

- a cylindrical intake duct 1 in which the mixture of powder and its transporting air, is brought, by a tubular passage not shown, at a flow rate generally varying from 2.5 to 6 $Nm^3/h$;
- a device for re-homogenizing the incident air-powder mixture, formed, in a known manner by a convergent-divergent passage 2;

a cylindrical duct 3 leading from passage 2 to circular deflector plate 4 perpendicular to the axis of the nozzle and supported by four arms 23;

a duct 5 intended to convert the cylindrical shape to a rectangular one, the said duct tapering from a cylindrical section 6 at its inlet end to a long, narrow outlet slit 7.

Figure 5:
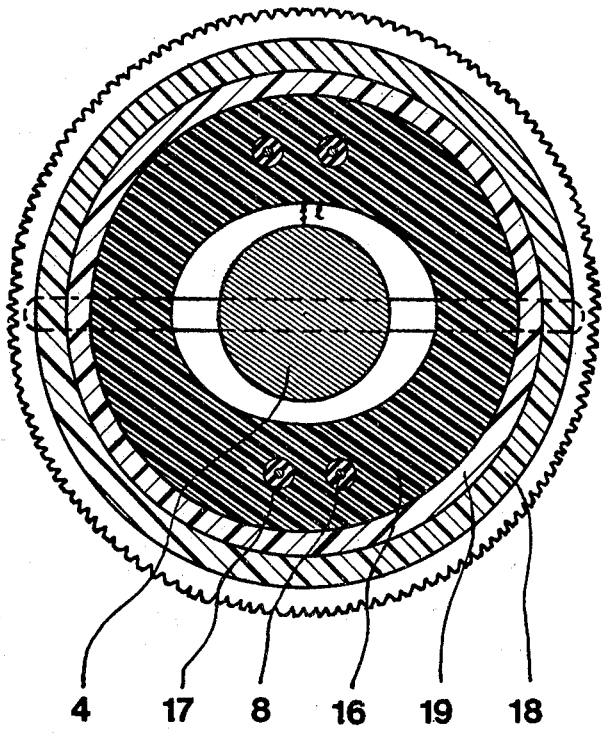
FIG. 5 is a transverse sectional view taken along the line (E – F) of FIG. 2.

As best seen in FIGS. 2 and 5, the position of deflector 4 in relation to duct 5 is important for obtaining adequate homogeneity of the powder spray at the nozzle exit 7. In fact the flow rate of the exit spray must, in order to be homogeneous, be constant all along the length of the outlet slit. If we consider the distance *l* between deflector 4 and the inner surface of conversion duct 5, we see that if this distance *l* is small, i.e. if plate 4 is placed well forward in duct 5, the powder comes through essentially at the sides of plate 4 and practically none at the top and bottom; this means that the stream at the far end of duct 5 goes through the outlet slit 7 mainly at its extremities. On the other hand, if the said distance *l* is great, i.e. if plate 4 is placed well back in duct 5, there is then a relatively large powder flow over the top or under the bottom of plate 4, and this powder, after passing through duct 5, goes through slit 7 mainly at its center. Adjustment to the intermediate position, shown in FIGS. 2 and 5, permits a homogeneous spray to be obtained all along the slit.

It is, moreover, easily understood that deflector 4 must be positioned inside conversion duct 5 and not in cylinder 6. If the deflector were in the cylinder 6, the powder flow would get past the deflector equally on all sides, and consequently the powder would pass mainly through the central part of slit 7 and very little at its edges, as is the case with the nozzle shown in FIG. 7 of U.S. Pat. No. 3,263,127. The role of deflector 4 would be then merely to slow down the powder stream, and it would not also impart homogeneity, as is the case with the present invention.

As is known in itself, the nozzle comprises four metal electrodes 8, 9, 10, 11 brought to a high voltage, designed to create the electric field between the nozzle and the grounded objects, and also to charge the powder particles by ion bombardment. The electrodes 8, 9, 10, 11 are lined up along slit 7 in order to obtain a Corona discharge pattern like that of FIG. 13 of U.S. Pat. No. 3,263,127.

As is shown on the drawings, the components described above are assembled mechanically and electrically in the following way:

Intake tube 1 and convergent-divergent passage 2 are formed in a cylindrical part 12 made of insulating material, surrounded by a metal cover 13 brought to a high voltage by an electric line not shown on the drawing.

An insulating part 14 next to part 12 supports deflector plate 4, as well as forming duct 3.

Two other insulating parts 15 and 16, joined side by side, form the cylindrical portion 6 and also conversion duct 5. The wires of metal electrodes 8, 9, 10, 11, covered by sheaths 17 made of insulating material, pass through these parts.

The assembly is held together by two, cylindrical insulating parts 18, 19 and a clamping nut 20. The metal cover 13 and the back parts of electrodes 8, 9, 10, 11 are electrically connected by means of metal bar 21 and ring 22.

Although the description describes the preferred embodiment of the nozzle according to the invention, it is obvious that the invention involves many possible variants and technical equivalents. For example, re-homogenizing device may be replaced either by a device comprising a stationary or rotating screw propeller, as described in French Additional Pat. No. 59,514, or by a system in which auxiliary air, which may or may not be swirling, is injected. The convergent-divergent device is, however, to be preferred, for it causes very little drop in load and thus very little reduction in the powder flow rate, particularly in the case of powder intake by means of a pneumatic ejector.

In this device the sections of the intake duct 1 and the throat of the convergent-divergent device 2 are so selected on conventional thermodynamic principles that the increased speed of the mixture within the throat necessarily causes turbulence in the throat. The angle of divergence beyond the throat is also selected to cause turbulence along the walls of the divergent part of the passage. This turbulence results in re-homogenization of the mixture, i.e., a more umiform distribution of the particles throughout the carrier gas.

The invention may be used in all industries where objects are coated by electrostatic powdering or flocking.

What is claimed is:

1. Method of forming and directing a homogeneous flat fan-spray of electrically charged particles derived from an incident stream containing a mixture of particles and carrier gas toward an article which is to be electrostatically coated with particles, which method comprises the steps of:

deflecting said incident stream outwardly in a direction substantially perpendicular to its incident direction, driving said deflected stream against the internal walls of a duct shaped to form the stream into a substantially homogeneous flat fan-spray, and then electrically charging the particles of said spray.

2. Method as claimed in claim 1 which comprises the step of causing said stream to pass between a deflector and the internal walls of the duct in the form of an annulus which is radially thicker near the ends of a first line through said deflector parallel to the principal plane of said flat fan-shaped spray than near the ends of a second line perpendicular to the first line.

3. Method as claimed in claim 1 which comprises the step of homogenizing the distribution of the particles of said incident mixture to provide a substantially uniform particle mixture in said incident stream before said substantially perpendicular deflection of said stream.

* * * * *